United States Patent [19]

Dufoug

[11] Patent Number: 4,683,381

[45] Date of Patent: Jul. 28, 1987

[54] CONTROLLED-ACCESS APPARATUS FOR THE AGRICULTURAL FOOD INDUSTRIES

[75] Inventor: Gilbert E. Dufoug, Paris, France

[73] Assignee: Ets. Bonnet, Sur Saone, France

[21] Appl. No.: 657,523

[22] Filed: Oct. 4, 1984

[30] Foreign Application Priority Data

Oct. 14, 1983 [FR] France ..... 83 16387

[51] Int. Cl.[4] ..... H01H 47/00

[52] U.S. Cl. ..... 307/125; 307/116; 361/179; 361/181; 192/130; 192/129 R

[58] Field of Search ..... 307/115, 116, 117, 120, 307/125, 132 V; 361/1, 179, 180, 181, 182, 183, 191; 366/132, 142, 151, 601, 603; 192/125 A, 127, 129 A, 129 R, 130, 133; 340/530, 531, 532, 562, 258 C

[56] References Cited

U.S. PATENT DOCUMENTS

| | | | |
|---|---|---|---|
| 2,963,627 | 12/1960 | Buchsbaum | 192/130 X |
| 3,147,408 | 9/1964 | Yamamoto et al. | 361/179 |
| 3,200,304 | 8/1965 | Atkins et al. | 361/179 |
| 3,483,437 | 12/1969 | Coyne | 361/181 |
| 3,504,236 | 3/1970 | Miyagawa et al. | 361/179 |
| 3,785,230 | 1/1974 | Lokey | 83/58 |
| 3,818,369 | 6/1974 | Brocker | 361/182 X |
| 3,829,850 | 8/1974 | Guetersloh | 361/181 X |
| 3,875,423 | 4/1975 | Kemper | 307/113 |
| 3,896,425 | 7/1975 | Erichsen | 340/258 B |
| 3,947,734 | 3/1976 | Fyler | 340/258 C X |
| 3,953,770 | 4/1976 | Hayashi | 307/116 X |
| 3,987,881 | 10/1976 | Perkins | 192/130 X |
| 4,016,490 | 4/1977 | Weckenmann et al. | 361/181 X |
| 4,029,996 | 6/1977 | Miffitt | 307/116 X |
| 4,075,961 | 2/1978 | Harris | 361/179 X |
| 4,088,856 | 5/1978 | Tebben | 192/129 A X |
| 4,208,695 | 6/1980 | Noda et al. | 307/116 X |
| 4,280,164 | 7/1981 | Kozek | 361/179 |
| 4,282,963 | 8/1981 | Kafura et al. | 192/133 |
| 4,362,196 | 12/1982 | Ferdinand et al. | 192/133 X |
| 4,412,268 | 10/1983 | Dassow | 361/181 |

FOREIGN PATENT DOCUMENTS

| | | |
|---|---|---|
| 2212430 | 9/1973 | Fed. Rep. of Germany . |
| 2463354 | 4/1983 | France . |
| 7112392 | 3/1973 | Netherlands . |
| 2116444 | 3/1982 | United Kingdom . |

OTHER PUBLICATIONS

Tool and Production, vol. 38-No.-Apr. 1972-p. 78-US "Product News".

*Primary Examiner*—William M. Shoop, Jr.
*Assistant Examiner*—Shik Luen Paul Ip
*Attorney, Agent, or Firm*—Cushman, Darby & Cushman

[57] ABSTRACT

In a controlled-access apparatus for agricultural food industries, means is provided within the space located between the rotary tool-holder and the edge of the opening of the vessel of the apparatus for a protection and access-control device which performs a double function, namely that of protecting the user against accidental bodily injuries and that of allowing penetration of/or access to agricultural food products or ingredients, utensils or instruments having predetermined characteristics such as zero electrical conductivity and nonmagnetic properties.

10 Claims, 5 Drawing Figures

CONTROLLED-ACCESS APPARATUS FOR THE AGRICULTURAL FOOD INDUSTRIES

BACKGROUND OF THE INVENTION

1. Field of the invention

The present invention relates to a controlled-access apparatus for the agricultural food industries.

2. Description of the prior art

Known equipment for agricultural food industries such as mixing or kneading machines having stationary or rotary vessels are often provided with a safety device for preventing access to the vessel during operation. This safety device is usually a mechanical device which closes the space between the rotary tool-holder and the edge of the vessel opening.

This safety device is often constituted either by a metal grid or by a solid screen which can be opaque or transparent. This mechanical safety device has proved effective up to the present time for protecting the user against accidental bodily injuries but is attended by a disadvantage, however, in the preparation of agricultural food products. In fact, some agricultural food products require constant supervision of the state of products being prepared or control of the degree of their evolution or else call for the addition of other products or ingredients during operation of equipment units and in predetermined stages of operation whereas the presence of this mechanical safety device hinders or prevents this supervision or introduction of products or ingredients.

Furthermore, this mechanical safety device which is designed in the form of a grid or element having a complicated structure is not readily conductive to easy maintenance of hygiene which is essential in the case of equipment employed in agricultural food industries.

In machine-tools such as presses, electronic protection systems already exist that delimit a field of protection about dangerous operating parts and actuate the shutting-down of these machines once the operator's hand or any object crosses the protection field. These known electronic systems are highly suitable for these presses or machine-tools, given that the operations carried out by them such as stamping, swaging, etc. of a metal sheet do not require any further human intervention during operation in order to achieve a desired result. However, in the case of preparing agricultural products, as recalled in the preceding paragraph, in an apparatus for the agricultural food industries such as a mixer or kneading machine such human intervention is required. On the other hand, these known electronic protection systems present the same drawbacks in the equipment for the agricultural food industries, as those indicated herein-above of a mechanical safety device, since these protection systems actuate the shut-down of this equipment once the instruments or the utensils used in a control of the degree of evolution of the products in preparation or the ingredients that must be added to these products in preparation, cross the field of protection developed by these systems.

SUMMARY OF THE INVENTION

The aim of the present invention is to overcome these disadvantages by providing an apparatus for agricultural food industries which is provided with a protection and access-control device which is economical, efficient, and easy to maintain from a hygienic standpoint.

This device carries out an adjustable selectivity of the bodies in order to allow to pass those which are authorized and to actuate the shutting-down of the apparatus upon arrival of those bodies which are forbidden.

In accordance with the invention, a controlled-access apparatus for agricultural food industries is mainly distinguished by the fact that provision is made within the space located between the rotary tool-holder and the edge of the opening of the vessel of said apparatus for a protection and access-control device through selectivity of bodies which performs a double function, namely that of protecting the user against accidental bodily injuries and that of allowing penetration or access of agricultural food products or ingredients, utensils or instruments having predetermined characteristics such as zero electrical conductivity and nonmagnetic properties.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
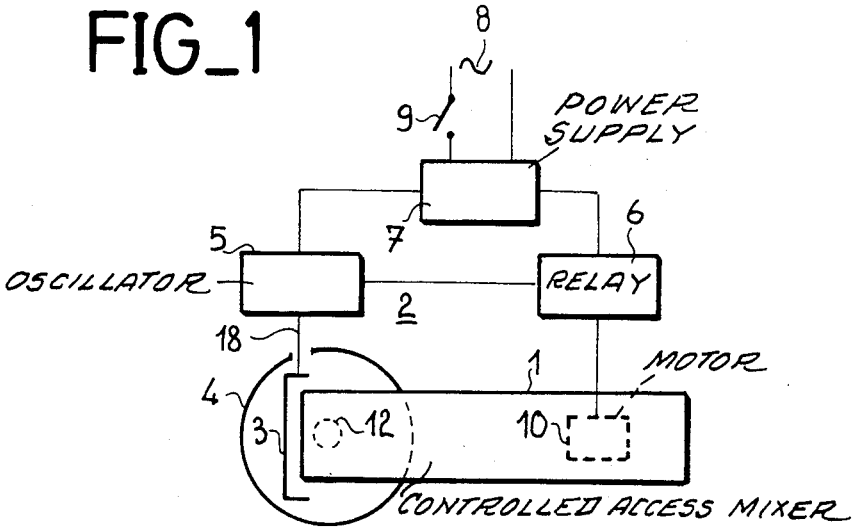
FIG. 1 is a block diagram of a mixer for agricultural food industries, said mixer being provided with a protection and access-control device in one embodiment of the invention.

An apparatus for agricultural food industries such as controlled-access mixer 1 as represented schematically by a rectangle in FIG. 1 comprises a device 2 which constitutes in conjunction with the frame and vessel of the mixer 1 a combination which makes it possible to perform two functions. The first function consists in protecting the user against accidental bodily injuries caused by rotating parts of the apparatus when this latter is in operation, this being achieved by cutting-off the supply of electric current to the motor employed for driving the apparatus. In other words, this actuates a shut-down of the functioning of the apparatus, as soon as the user or part of his body is located at a predetermined and adjustable distance from the rotating portions of the apparatus. The second function consists in controlling the access to this apparatus, in particular to the vessel which contains the products to be subjected to a predetermined food-product preparation process and in which the work tool of the apparatus is rotatably mounted. This control operation consists in permitting free access to said vessel without acting on the operation of the apparatus only by agricultural food products or ingredients and preparation instruments or utensils having certain predetermined characteristics.

Figure 2:
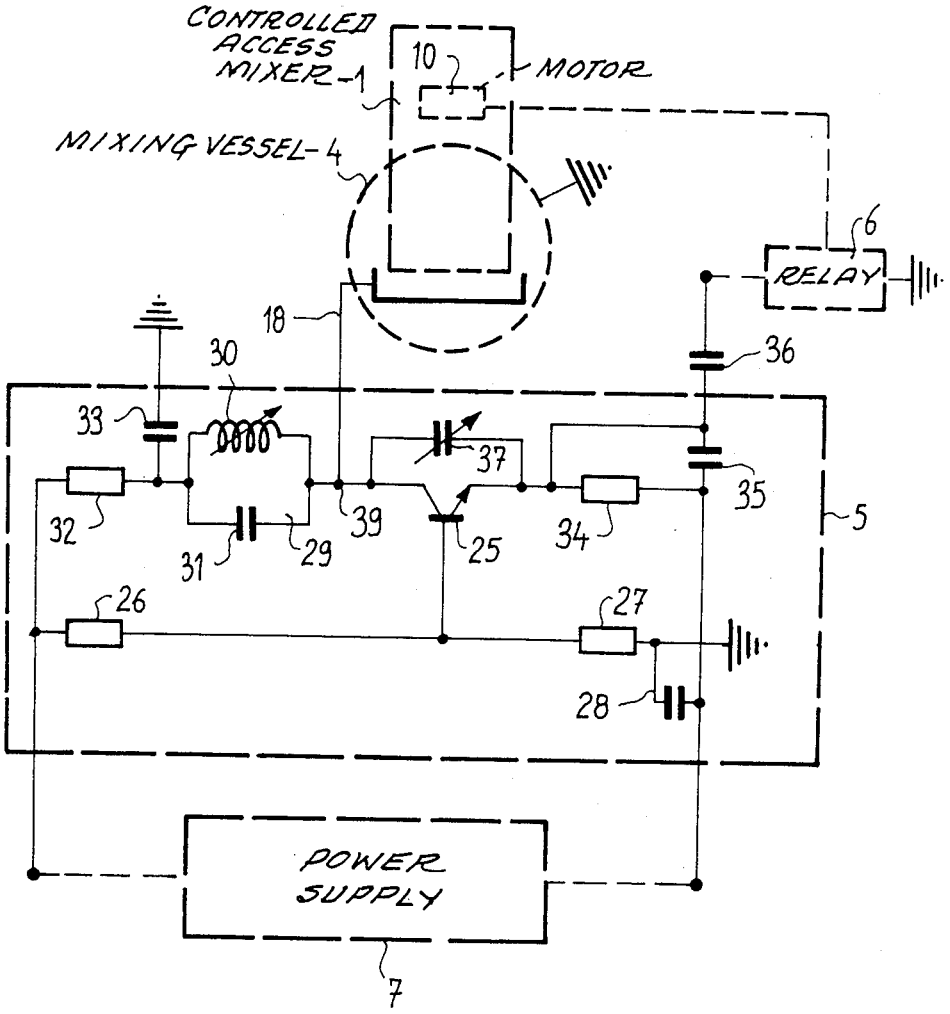
FIG. 2 is a partial electrical diagram of the apparatus of FIG. 1, showing a stage of oscillators of the electrical assembly of the protection device and access control.

In the example illustrated in FIG. 1, the protection and access-control device 2 comprises a detector 3 developing an electric field which is placed within the space between the rotary tool-holder of the mixer 1 and the edge of the opening of the mixing vessel 4 in order to form an immaterial screen for protecting and controlling the access to said space. The detector 3 can be constituted by a sensor element of an electrical assembly of a known type having an oscillator stage 5 and a stage with an electromagnetic relay 6 which usually serves as an alarm device: as the user moves toward or away (i.e. the presence or the absence) from the alarm device, the impedance of the oscillator stage 5 is modified, thus producing respectively a break-off or restoration of the oscillation, thereby causing energization or de-energization of the relay stage 6. This device can further comprise a power supply circuit 7 which is connected to an electric current source 8 via a switch 9. Referring to FIG. 2, oscillator stage 5 comprises a transistor 25 the base of which is polarized by a voltage divider constituted by two resistances 26,27 connected in series to the terminal of the power supply circuit 7 and provided with a decoupling capacitance 28. An oscillator circuit 29 includes an adjustable inductance 30 and an undulator (or capacitor) 31 in parallel is mounted coupled to the collector of the transistor 25 and in series with a decoupling cell comprising a resistance 32 and a capacitance 33. The detector is connected to a node 39 situated between the oscillator circuit 29 and the collector of the transistor 25 through the conductor 18. The circuit of the emitter of the transistor 25 comprises a resistance 34 on which is collected through capacitances 35,36 the control signal of the electromagnetic relay stage 6. A variable capacitance 37 mounted between the emitter and the collector of the transistor 25 which allows by its adjustment a control of the operating point of oscillator 5, i.e. the restoration and break-off limit points of oscillator 5 at the selected impedance variations limits of oscillator stage 5 provoked by the presence of bodies the passage of which is or is not authorized in the field of protection developed by the protection and access-control device 2. These limits are determined so that the bodies whose passage is authorized, such as instruments or preparation utensils having preselected physical characteristics or the additional products or ingredients only provoke impedance variations of oscillator stage 5 lower than these limits while the bodies whose passage is forbidden, such as the human body or a member thereof, only provoke impedance variations of the oscillator stage 5 higher than these limits.

When the oscillation occurs in oscillator stage 5, a current that appears at the terminals of resistance 34, is transmitted through the capacitance 36 to the electromagnetic relay stage 6 in order to determine a non-excitation of the relay and consequently normal operation of the mixer. Once break-off of the oscillator occurs, the current at the terminals of the resistance 34 is cut off, thereby provoking excitation of the relay stage 6 which actuates the shut-down of the mixer.

Figure 3:
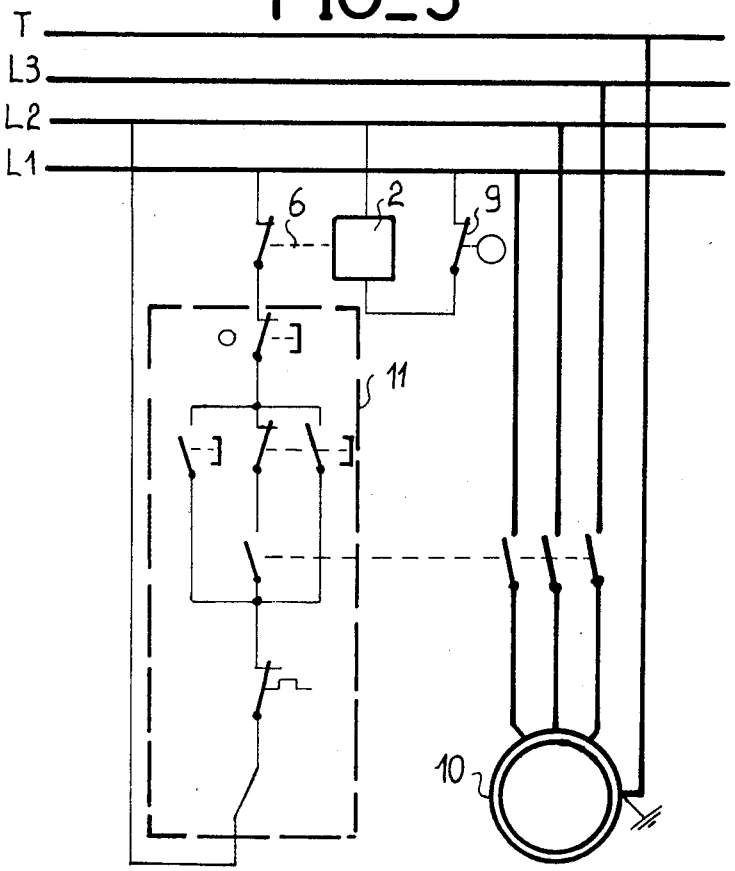
FIG. 3 represents a partial electrical diagram of the apparatus of FIG. 1, showing an electric supply circuit of the mixer of FIG. 1.

In the example given, the function of the relay of stage 6 of the electrical assembly of the protection and access-control device 2 is to initiate starting or stopping of a motor 10 for driving the mixer 1 (shown in FIG. 1) via a known contactor 11 of the self-energizing type (shown in FIG. 3). By way of example, the motor 10 is a three-phase motor supplied from a three phase power supply system $L_1$, $L_2$, $L_3$, T. In mixer 1, the device 2 stops the operation as soon as the user enters the pre-set forbidden zone developed by the detector 3. On the other hand, said device 2 allows access to the mixing vessel 4 by the agricultural food products or ingredients and by the preparation utensils or instruments which are not electrically conductive or nonmetallic and nonmagnetic.

It is ensured that the user is protected against accidental bodily injuries while being permitted to carry out the task of supervising, controlling and freely performing remote preparations by means of instruments which are not electrically conductive, are nonmagnetic and have an adequate length, and of freely introducing into the vessel 4 of the mixer 1 the products or ingredients contained in nonconductive and nonmetallic utensils without disturbing the operation of said mixer 1.

Figure 4:
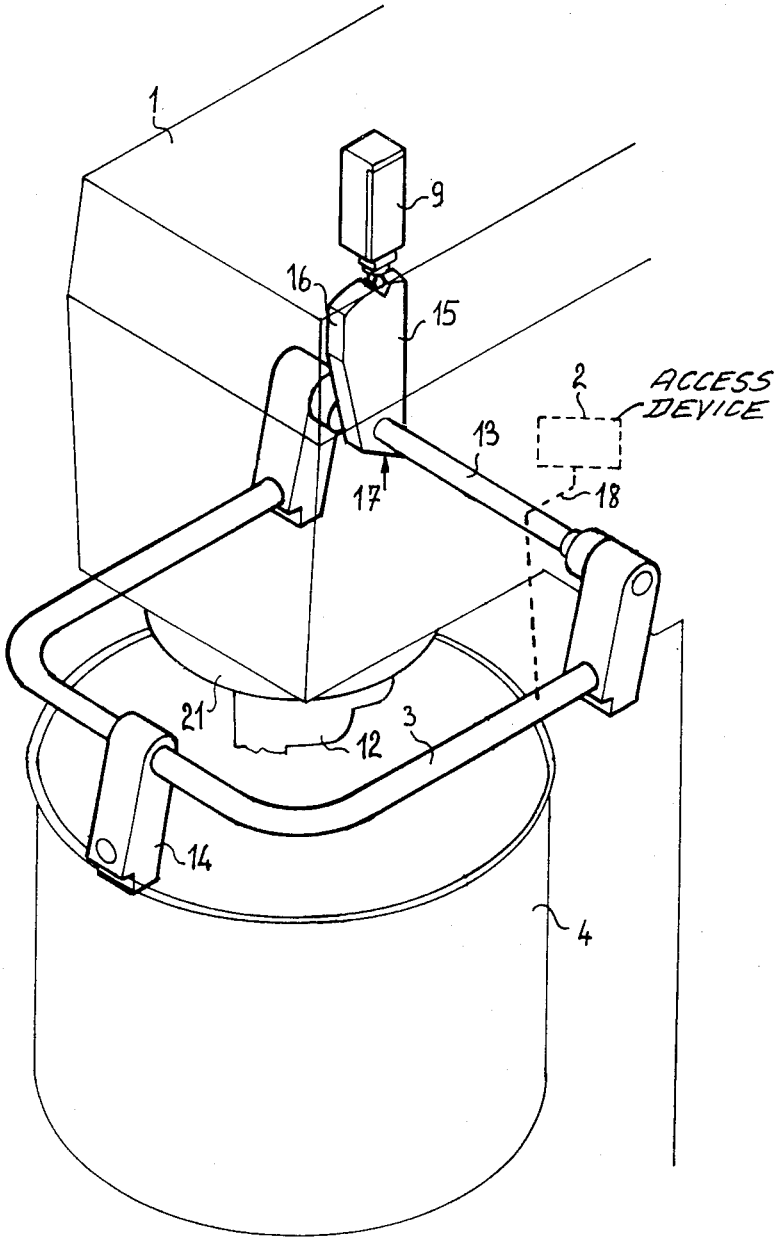
FIG. 4 is a partial schematic view of one exemplified embodiment of the apparatus of FIG. 1.

In an example which is illustrated in FIG. 4, the detector 3 is designed in the form of a U-shaped rod or wire and is placed within the space between the tool-holder 12 and the edge of the opening of the mixing vessel 4 and fixed on a shaft 13 which is pivotally mounted on the frame of the mixer 1. The detector 3 is provided with stops which determine its rest position (not shown) and its operating position as shown in FIG. 4.

In the example illustrated, the detector 3 comprises a front stop 14 which in the operating position of the detector rests on the edge of the mixing vessel 4. There is also fixed on the pivotal shaft 13 of the detector 3 a cam 15 for causing the power supply switch 9 of the electrical assembly comprising an oscillator stage 5 and a relay stage 6 to close when the detector 13 is in the operating position shown in FIG. 4 and for causing said switch 9 to open when the detector 3 is in the rest position (not shown). The small faces 16 and 17 of the cam 15 can constitute stops which determine the degree of pivotal displacement of the detector 3 or its inactive and operating positions. The detector 3 is preferably connected to the electrical assembly comprising the oscillator stage 5 and a relay stage 6 of the device 2 by means of a coaxial cable shown as a dashed line 18.

Figure 5:
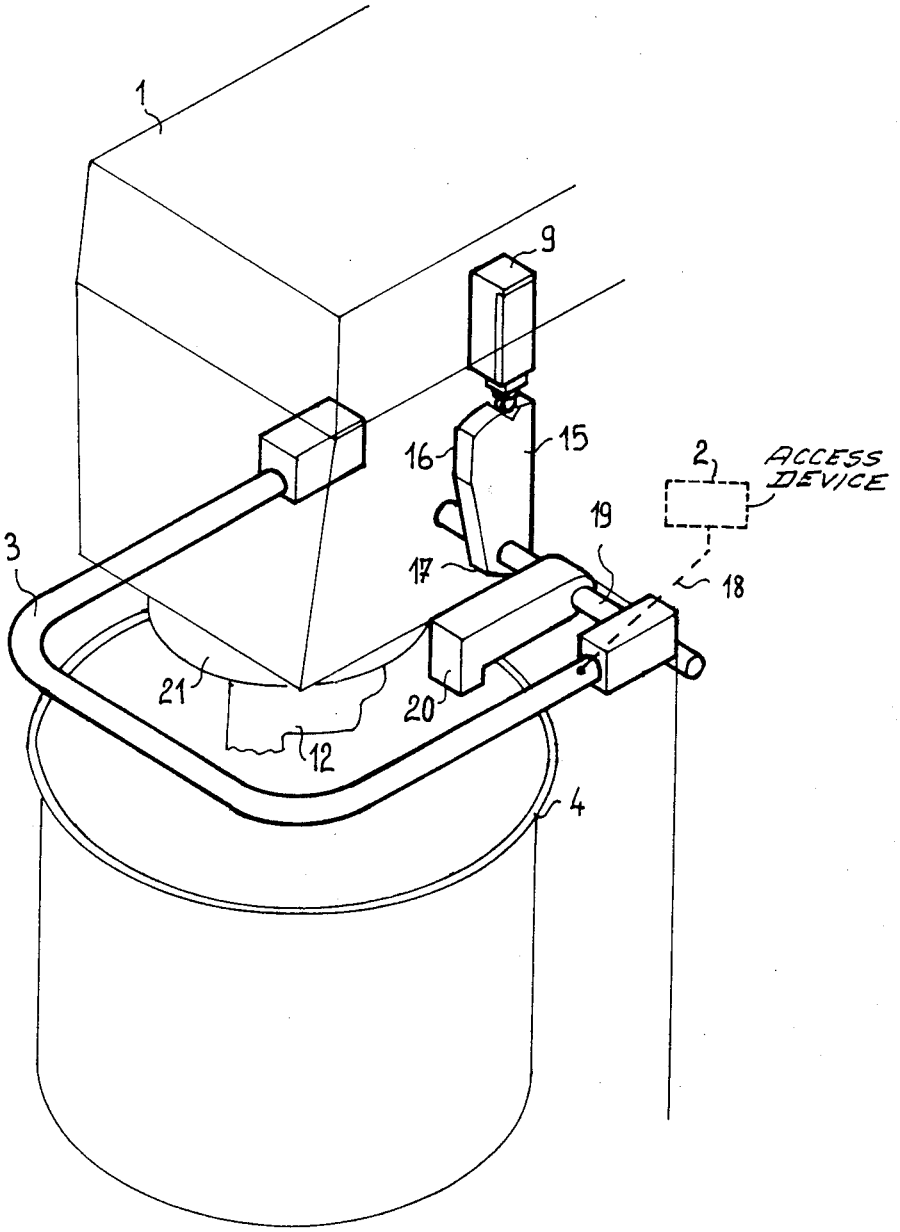
FIG. 5 is a partial schematic view of another exemplified embodiment of the apparatus of FIG. 1.

In another example shown in FIG. 5, the detector 3 is fixed and mounted on the frame of the mixer 1 whilst the cam 15 which controls the closing and opening of the switch 9 is fixed on a shaft 19 pivotally mounted on the frame of the mixer 1. A stop 20 is also fixed on the shaft 19 in order to initiate closing of the switch 9 in conjunction with the cam 15 as soon as said stop 20 comes to rest on the vessel 4 of the mixer 1. The stop 14 (shown in FIG. 4) and the stop 20 (shown in FIG. 5) are provided with a number of shouldered portions which enable them to rest correctly on the edges of the openings of various types of vessels 4 which have different pre-determined dimensions and are adapted to the preparations performed by the mixer 1.

The detector 3 has a simple shape and structure and is easy to maintain in order to achieve the essential standard of hygiene in equipment for agricultural food industries. The detector 3 can have any shape other than the U-shape shown in the drawings.

In an example which has not been illustrated, the detector 3 is mounted in the frame of the mixer 1 within the portion 21 (shown in FIGS. 4 and 5), which surrounds the tool-holder 12. In order to provide the detector with its maximum degree of efficiency, the external wall of the portion 21 and the portion of the frame located in the vicinity of said detector is formed of electrically nonconductive and nonmagnetic material or of material which does not afford any resistance to the efficiency of the detector 3 which develop an electric field within the delimited zone which the user is forbidden to enter and which is located between the tool-holder 12 and the edge of the opening of the vessel 4 of the mixer 1.

In the apparatus 1 for agricultural food industries, the U-shaped wire detector 3 provides the user with large and free available spaces which permit each access to the vessel 4 in which the work tool is rotably mounted, by means of electrically nonconductive and nonmagnetic instruments. The zone which the user is forbidden to enter and which extends over the space between the tool-holder 12 and the edge of the opening of the mixing vessel 4 is made adjustable in known manner by means of the electrical assembly which comprises the oscillator stage 5 and the relay stage 6 and to which the detector 3 is connected.

The device in accordance with the invention for providing protection and control of access to the mixer 1 offers an appreciable advantage over the known alarm or safety system, although this latter has a similar structure. In both its design objective and practical application, the known system has only a single function of protection or prevention which it ensures with absolute stringency as soon as the forbidden zone delimited by the detector is violated or penetrated by the user. This single function of the system is performed by producing an alarm signal for shutting-down an installation or initiating operation of a protective device which prevents any entry or accidental bodily injury.

In contrast to this known system, the controlled-access apparatus in accordance with the invention for agricultural food industries is not limited to the above-mentioned function of protection or prevention by means of said alarm or safety system. The additional function of the present device is to permit access or introduction of certain elements having predetermined characteristics such as electrically nonconductive or nonmagnetic properties with respect to agricultural food products or ingredients. Such elements can consist of the preparation utensils and instruments intended for use with the mixer 1 as described in the foregoing.

What is claimed is:

1. A controlled-access apparatus for an agricultural food apparatus having a vessel with an opening and a tool-holder, comprising:

means provided within a space located between the tool-holder and an edge of the opening of the vessel of said apparatus, for detecting a characteristic of an object located in the vicinity of the detecting means, and producing a signal indicative thereof; and protection means for selectively acting on the food apparatus allowing agricultural food products or ingredients, utensils and instruments located in the vicinity of the detecting means and which produce impedance variations lower than predetermined limits to be located in the vicinity of said apparatus without acting on the operation of the apparatus, and shutting off the apparatus when objects which produce impedance variations higher than said predefined limits are detected in the vicinity of the detecting means, said predefined limits chosen so that a member of a human body will shut off said apparatus.

2. An apparatus according to claim 1, wherein the detecting means comprises a detector which develops an electric field, and which is located within a space between the tool-holder and the edges of the opening of the vessel and wherein said protection means includes (1) oscillating means for allowing the passage of agricultural food products and ingredients, predetermined preparation utensils and instruments to be located in the vicinity of the detecting means if they produce electric impedance variations lower than said predetermined limits, said predetermined limits being limits of interrupting an oscillation of the oscillating means, thereby allowing their access to the vessel without acting on the operation of the apparatus, and for turning off the oscillation of the oscillator when at least one of a member of a human body and objects which produce electric impedance variations higher than said predefined limits are located in the vicinity of the detecting means, and (2) relay means for interrupting the supply of current to the drive motor of the apparatus when the break-off of the oscillation occurs.

3. An apparatus according to claim 2, wherein the detector has a U-shaped single-wire structure and is fixed on a shaft pivotally mounted on the frame of the food apparatus to have one rest position and one work position.

4. An apparatus according to claim 2, wherein the detector is placed in the frame of a apparatus within the portion which surrounds the tool-holder and is provided with an external wall formed of material which does not afford any resistance to the developing of the electric field by said detector.

5. Apparatus as in claim 1 further comprising means for adjusting a sensitivity of said detecting means to characteristics of the object.

6. Apparatus as in claim 1 wherein said acting on operation is a shut off of said food apparatus.

7. An apparatus according to claim 2, wherein the detector is fixed on a pivotal shaft with a work position and a rest postion and said protection means includes a switch which selectively couples power thereto, and further comprising cam means fixed on the pivotal shaft of the detector for closing the power supply switch when the detector is in the work position, and for opening the power supply switch when said detector is in the rest position.

8. An apparatus according to claim 2, wherein the detector is fixed on the frame of the apparatus and said protection means includes a switch which selectively couples power thereto, and, further comprising operating means, including a cam and a stop fixed on a shaft which is pivotally mounted on the frame of the apparatus to have a work position and a rest position, for closing of the power supply switch when said stop is returned to its work position and rests on the edge of the vessel of the apparatus, and for opening the power supply switch when the stop is returned to its rest position in a movement of pivotal displacement.

9. An apparatus according to claim 7, wherein the detector comprises a front stop which rests on the edge of the vessel of the apparatus when the detector is located in the operating position.

10. An apparatus according to claim 7 or claim 8, wherein the cam comprises small faces which serve as stops for limiting the degree of pivotal displacement of said cam.

* * * * *